US005716004A

United States Patent [19]

Byles

[11] Patent Number: 5,716,004

[45] Date of Patent: Feb. 10, 1998

[54] RETRACTABLE IRRIGATION APPARATUS AND METHOD

[75] Inventor: Joe D. Byles, San Antonio, Tex.

[73] Assignee: Nibco, Inc., Elkart, Ind.

[21] Appl. No.: 426,813

[22] Filed: Apr. 20, 1995

[51] Int. Cl.[6] ..... B05B 15/10

[52] U.S. Cl. ..... 239/205; 239/203; 239/204

[58] Field of Search ..... 239/229, 204, 239/205, 533.1, 533.13, 533.15, 542, 553, 553.5, DIG. 12

[56] References Cited

U.S. PATENT DOCUMENTS

| | | | |
|---|---|---|---|
| 1,853,805 | 4/1932 | Elder | 239/205 |
| 2,744,786 | 5/1956 | Whitehead | 239/229 X |
| 2,771,320 | 11/1956 | Korwin | 239/533.13 X |
| 2,814,529 | 11/1957 | Arnt | 239/533.13 X |
| 3,258,205 | 6/1966 | Hruby, Jr. | 239/204 |
| 4,915,312 | 4/1990 | Hiemstra | 239/205 X |

FOREIGN PATENT DOCUMENTS

| | | | |
|---|---|---|---|
| 751363 | 7/1980 | U.S.S.R. | 239/204 |

*Primary Examiner*—Robert J. Oberleitner
*Assistant Examiner*—C. J. Bartz
*Attorney, Agent, or Firm*—Shaffer & Culbertson; Russell D. Culbertson

[57] ABSTRACT

An irrigation apparatus (10) includes a conduit housing (14) with at least one elongated, flexible irrigation conduit (12) received in a retracted position therein. A water supply arrangement associated with the conduit housing (14) allows water to be supplied through the housing to a proximal end (20) of each irrigation conduit (12). Also, a conduit deployment arrangement associated with the conduit housing (14) allows the irrigation conduits (12) to extend from the housing to an extended position in response to water supplied to the housing through the water supply arrangement. In the extended position, each irrigation conduit (12) extends over an area to be irrigated, and emitters along the length of each conduit emit water to efficiently irrigate the area under and immediately surrounding the extended conduit. A conduit retracting arrangement (32) retracts the irrigation conduits (12) back to the retracted position once the water pressure is withdrawn from the device.

20 Claims, 4 Drawing Sheets

RETRACTABLE IRRIGATION APPARATUS AND METHOD

BACKGROUND OF THE INVENTION

This invention relates to irrigation devices and methods, and more particularly to an apparatus and method for extending irrigation conduits to efficiently irrigate an area and then retracting the conduits after irrigation.

A large percentage of the total water used in the U.S. and elsewhere goes to irrigate lawns and landscapes. However, many current practical irrigation methods make very inefficient use of water and contribute greatly to the exhaustion of water reserves in many areas. Spray head systems, which are the most commonly used systems, lose water to evaporation, runoff, and overspray. The spray droplets from spray heads are vulnerable to wind and are often blown out of the area intended to be irrigated, contributing to the overspray problems. Runoff occurs because spray heads tend to deliver water too quickly for the water to be absorbed into the ground in the area being irrigated. Another problem with spray systems is that overspray can hit structures such as houses and fences, causing discoloration or staining.

Surface drip irrigation systems use an extensive network of conduits with spaced apart emitters for emitting water at slow rates directly to the surface to be irrigated. These surface drip irrigation systems can eliminate runoff, overspray, and evaporation problems, but are practical only for landscape settings in areas not subject to traffic and, even in those situations, are not practical for dense landscapes. If used in high traffic areas such as turf areas, the conventional drip irrigation conduits must be picked up after irrigation and are therefore impractical in those settings. Also, in turf areas and dense landscapes, the spacing of emitters must be very close in order to provide sufficient water, too close to be practical in many situations.

SUMMARY OF THE INVENTION

It is therefore a general object of the invention to overcome the above-described problems and others associated with irrigation devices and methods, particularly devices and methods for turf and landscape irrigation.

In order to accomplish this object, the apparatus according to the invention includes at least one flexible or partially flexible irrigation conduit, and preferably a plurality of irrigation conduits which are extended to an extended position to efficiently irrigate a large area. After applying the desired amount of water to the area to be irrigated through a series of emission orifices spaced along the irrigation conduits, each conduit is retracted to a retracted position in a housing for storage.

One type of housing according to the invention comprises an elongated chamber made either of rigid or flexible material or a combination of a lower rigid section and an upper flexible section. Each conduit is slideably received through a deployment opening at one end of the elongated housing chamber, so that it may telescope in and out of the housing. Extending the conduits in this elongated housing form of the invention involves applying water pressure to a proximal end of each conduit in the housing. The water pressure causes the conduit to slide or telescope out of the housing through the respective deployment opening or deployment means to the extended position. A guide arrangement associated with the deployment opening directs the conduits radially outwardly from the housing. When the water pressure is removed, retracting means pulls the conduits back to the retracted position in the housing. The retracting means may comprise an extension or compression spring or an elastomeric band connected between the conduits and housing. The housing itself may be positioned below the surface of an area to be irrigated with the deployment openings being exposed generally at ground level. When the housing is made of rigid material, it extends vertically below the surface, whereas a housing of flexible material may be coiled nearer the surface. When the housing includes a rigid lower section and a flexible upper section, the flexible section may be bent so that the rigid section extends either vertically or horizontally, or at any angle in between.

In the form of the invention having a rigid housing or a rigid lower section for the housing, an individual guide tube is positioned in the housing for each irrigation conduit. Each irrigation conduit telescopes out of its respective guide tube to reach the extended position. An individual retracting mechanism is associated with each guide tube and irrigation conduit to pull the irrigation conduit back to the retracted position after water pressure is removed. The retracting mechanism may comprise a compression spring, an extension spring, or an elastomeric band operating directly on the irrigation conduit or connected through a pulley associated with the guide tube.

An alternative housing comprises an enclosure similar to that used in a retracting spray head. In this alternative form of the invention, the irrigation conduit comprises a thin, collapsed "tape" type conduit and each has associated with it a coiling mechanism such as a coiling spring. The coiling spring causes the irrigation conduit to flatten and coil up from a distal end to a proximal end when no water pressure is applied to the proximal end of the irrigation conduit. When water pressure is applied to the proximal end of the irrigation conduit, the pressure overcomes the spring force, unrolling and expanding the irrigation conduit and extending it to an extended position. In this form of the invention, all irrigation conduits are connected to receive water from a pop-up stem and manifold, which elevates the conduits above ground level to allow the conduits to unroll. When water pressure is removed from the enclosure and pop-up stem, the irrigation conduits are rolled up under the force from the coiling spring and the stem and rolled up conduits retract into the housing. The housing is preferably buried below ground level, similar to a pop-up spray head.

With either type of housing and conduit retracting means, the irrigation conduits are arranged to extend substantially radially about the housing when in the extended position. Each irrigation conduit has a plurality of emitters or orifices spaced apart along its length, and the emitters drip or spray water efficiently to the area immediately below and surrounding the irrigation conduit.

Because the irrigation conduits are radially spaced apart about the housing, the space between conduits is greater toward the distal end which extends from the housing in the extended position. In order to irrigate the entire area including the area between adjacent irrigation conduits, the conduit emitters or orifices are spaced further apart and have a larger flow rate toward the distal end of each conduit to irrigate a larger area. By choosing the appropriate spacing and flow rate for each emitter or orifice, the radially extending irrigation conduits effectively irrigate the entire area to which they extend, including the area between adjacent radially extending conduits. The larger flow rate emitters or orifices irrigate a larger diameter area to the same depth as the lower flow rate emitters. This larger diameter irrigated area is sufficient to efficiently cover the wider spacings between irrigation conduits toward their distal ends.

These and other objects, advantages, and features of the invention will be apparent from the following description of the preferred embodiments, considered along with the accompanying drawings.

DESCRIPTION OF THE PREFERRED EMBODIMENTS

Figure 2:
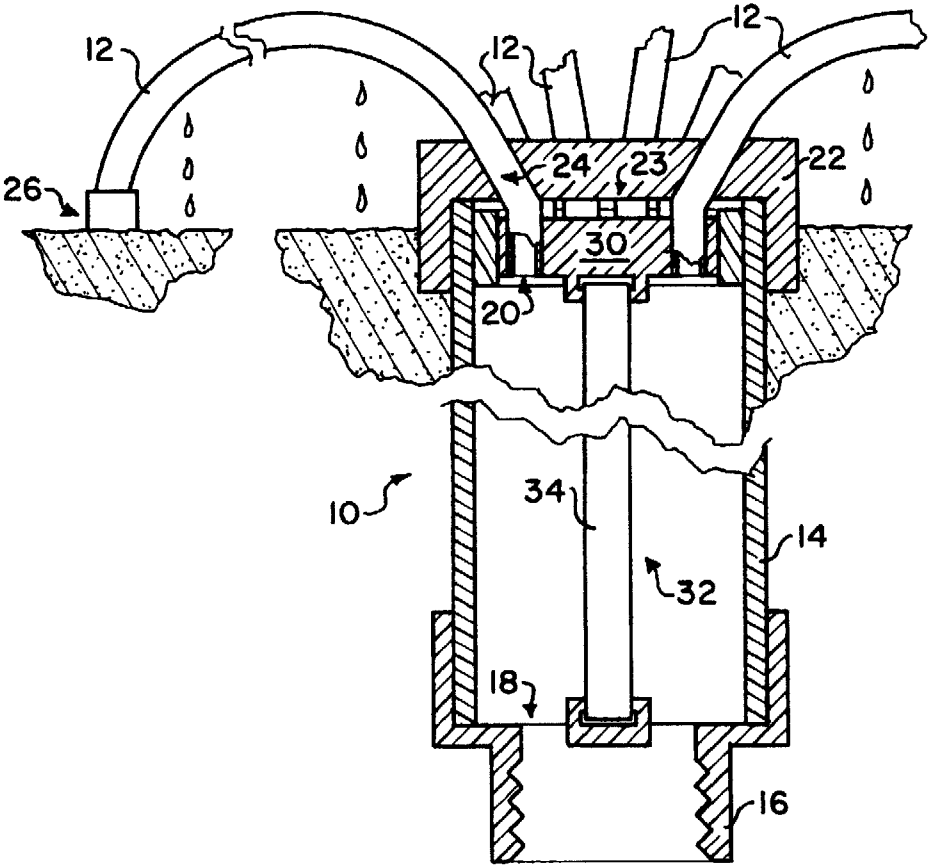
FIG. 2 is a partial longitudinal section view similar to FIG. 1, but showing the irrigation conduits in the extended position.
Figure 1:
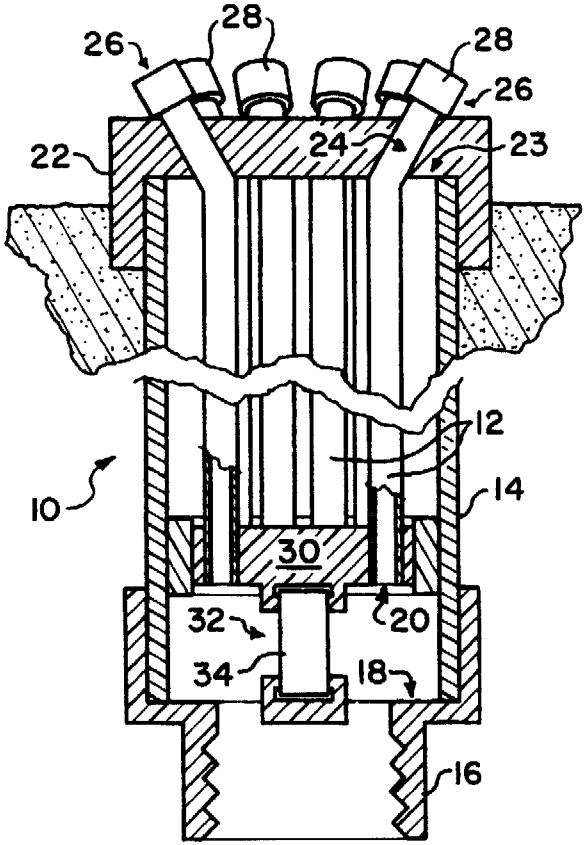
FIG. 1 is a view in longitudinal section of an irrigation apparatus embodying the principles of the invention, showing the irrigation conduits in the retracted position.

FIGS. 1 and 2 show one preferred form of irrigation apparatus 10, embodying the principles of the invention. FIG. 1 shows the apparatus 10 with a plurality of spaced apart irrigation conduits 12 in a retracted position. Although a plurality of irrigation conduits 12 is shown for purposes of illustration, the invention is not limited to a particular number of conduits. Rather, the apparatus could employ any number of irrigation conduits, depending upon the particular application. For irrigating relatively large areas for example, the apparatus may include eight irrigation conduits, while smaller areas may require fewer. Even a single irrigation conduit may be used when it is desired to irrigate a narrow strip, such as a strip of lawn between a street and sidewalk. In any event, the irrigation conduits 12 also each include emitters or orifices (not shown) spaced apart along their length. The emitters may be turbulent flow path plastic emitters embedded within the conduit or mere holes drilled in the conduit in some fashion. As discussed with reference to FIG. 8 below, the emitters have an increased spacing and flow rate from the proximal to distal end of the irrigation conduits.

The apparatus 10 includes a housing comprising a housing chamber 14, which is made of a flexible tube in the embodiment shown in FIGS. 1 and 2. An inlet fitting 16 is formed at a lower end 18 of the housing chamber 14 for connecting the chamber to a water supply. The inlet fitting 16 and housing chamber 14 form a water supply structure by which water may be applied to a proximal end 20 of each irrigation conduit 12. The housing chamber 14 also includes a top cover 22 at a discharge end 23 with a deployment opening 24 for each irrigation conduit 12. One of the irrigation conduits 12 is slideably received in each deployment opening 24, and each deployment opening preferably includes a TEFLON bushing (not shown) or some other lubricating arrangement that helps allow the conduit to slide easily with respect to the deployment opening. Also, each deployment opening 24 is preferably angled or curved outwardly to direct its respective irrigation conduit when the conduit is being deployed or extended to an extended position, as will be discussed below.

Each irrigation conduit 12 includes a distal end 26 with an end cap 28, or some other type of closure. In the form of the invention illustrated in FIGS. 1 and 2, the proximal end 20 of each irrigation conduit 12 is connected to a traveling element 30 slideably received in the housing chamber 14 and forming a substantial seal with the housing chamber inner wall. In the retracted position shown in FIG. 1, the irrigation conduits 12 reside inside the housing chamber 14, with the traveling element 30 residing near the lower end 18 of the housing chamber 14.

The apparatus 10 also includes retracting means 32. The retracting means in this form of the invention comprises a length of elastomeric material 34 connected between the traveling element 30 and the lower end 18 of the housing chamber 14. The elastomeric material 34 serves to bias the traveling element 30 and all irrigation conduits 12 toward the lower end 18 of the housing chamber. This biasing force returns the irrigation conduits 12 to the retracted position in FIG. 1 from the extended position shown in FIG. 2.

Referring to FIG. 2, the irrigation conduits 12 may also reside in an extended position in which the distal end 26 of each conduit extends outwardly from the housing chamber 14 over an area to be irrigated. The traveling element 30 and proximal end 20 of each irrigation conduit 12 generally abuts the top cover 22 of the housing chamber 14 when the conduits are in this extended position. In order to accommodate the position of the traveling element 30 and irrigation conduits 12 in the extended position, the elastomeric material 34 is stretched upwardly from the lower end of the housing chamber.

In operation, the apparatus 10 begins in the position shown in FIG. 1, with the irrigation conduits 12 in the retracted position, biased into the housing chamber 14 by the elastomeric element 34. Applying water to the inlet fitting 16 under an operating pressure causes the traveling element 30 and irrigation conduits 12 to slide upwardly to the position shown in FIG. 2, with the conduits then in the extended position. In order to extend the irrigation conduits 12 to the extended position, the operating pressure of the water must be sufficient to overcome the force applied by the elastomeric element 34 and frictional forces to slide the traveling element 30 and conduits upwardly. Also, once in the extended position, water applied to the irrigation conduits 12 exits the emitters or orifices at a flow rate to provide the desired wetting pattern, as will be discussed with reference to FIG. 8. In fact, water is emitted from the irrigation conduit emitters or orifices as the conduits are being extended, which provides a flushing action at the deployment openings 24. However, when the water pressure is withdrawn from the inlet fitting 16, the biasing force applied by the elastomeric element 34 pulls the traveling element 30 and the irrigation conduits 12 downwardly toward the lower end 18 of the housing chamber 14, and ultimately to the retracted position shown in FIG. 1. Thus, the apparatus 10 according to the invention can extend drip emitter conduits to efficiently irrigate a large high traffic area and then retract the conduits to the retracted position shown in FIG. 2 between water applications.

In the form of the invention shown in FIGS. 1 and 2, the housing chamber 14 is made of a flexible tubular material that may be coiled up and buried relatively near the soil surface. The inlet fitting 16 may be connected to a riser (not shown) such as a standard riser in a buried sprinkler head irrigation system. However, in the embodiment shown in FIGS. 3 and 4, the irrigation apparatus 40 includes a rigid elongated housing chamber 42 that may be buried substantially vertically below the soil surface. In this form of the invention, the housing chamber 42 includes a sealed lower end 44 and an upper discharge end 46. Unlike the inlet fitting in the embodiment shown in FIGS. 1 and 2, the apparatus 40 includes an inlet fitting 48 extending into the side of the housing 42 near the discharge end 46. The threaded inlet fitting 48 cooperates with the housing chamber 42 to form a water supply structure for supplying water to the proximal end 50 of the irrigation conduits 52.

Figure 4:
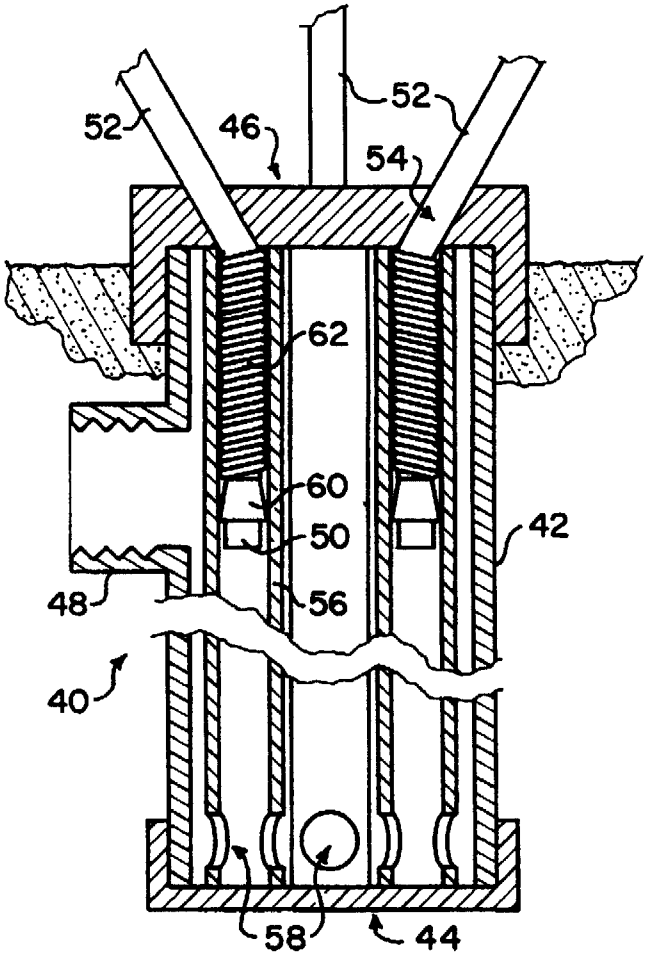
FIG. 4 is a partial longitudinal section view similar to FIG. 3, but showing the irrigation conduits in the extended position.
Figure 3:
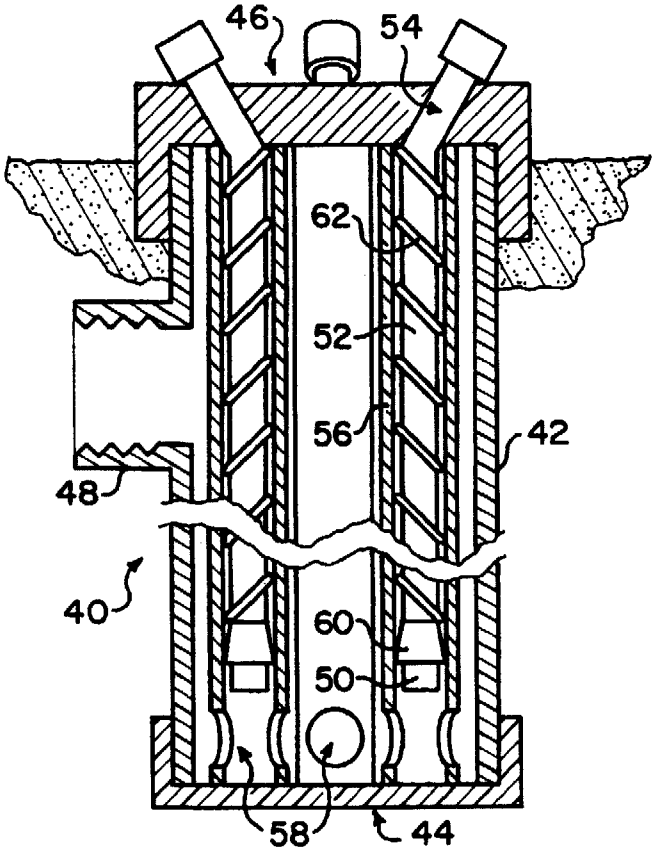
FIG. 3 is a view in longitudinal section showing an alternate form of the irrigation apparatus with the irrigation conduits in a retracted position.

Similarly to the embodiment shown in FIGS. 1 and 2, the form of the invention shown in FIGS. 3 and 4 also includes a plurality of irrigation conduits 52. Each irrigation conduit 52 is adapted to slide through a deployment opening 54 in the discharge end 46 of the housing chamber 42. Also, each irrigation conduit 52 in this form of the invention is received within a separate guide tube 56 extending longitudinally through the housing chamber 42. Each guide tube 56 includes a water inlet 58 at a lower end thereof, for allowing water to flow from the housing chamber 42 into the guide tube and ultimately to the irrigation conduit 52 received in the guide tube.

Each irrigation conduit 52 includes a stop element 60 at its proximal end 50. The stop element 60 forms a sliding seal with the guide tube 56 within which it is received, and allows water pressure to be applied efficiently to the proximal end 50 of the irrigation conduit 52. The stop element 60 also serves to stop the upward travel of each irrigation conduit 52 at the extended position shown in FIG. 4.

The retracting means shown in the embodiment of FIGS. 3 and 4 comprises a suitable compression spring element 62 acting between the top of the respective guide tube 56 and the respective stop element 60. Each spring 62 biases its respective irrigation conduit 52 to the retracted position, with the conduit received completely in the housing chamber 42 and respective guide tube 56. Although the compression spring is shown for purposes of illustration, other types of biasing arrangements may be employed within the scope of the invention. For example, the retracting means may alternatively comprise an extension spring connected between the irrigation conduit 52 proximal end and the bottom of the housing chamber 42. Also, the retracting means may comprise an elastomeric element connected to the proximal end of the irrigation conduit 52. The elastomeric element may be connected to the housing chamber 42 or to the respective guide tube 56. In this latter arrangement, the elastomeric element may extend around a pulley connected to the guide tube 56 with the end of the element connected to the outside of the guide tube.

In operation, water applied to the inlet 48 of the apparatus 40 shown in FIG. 3 flows into the housing chamber 42 and through guide tube water inlets 58 to apply pressure to the proximal end 50 of each irrigation conduit 52. The pressure of the water is sufficient to overcome the biasing force of the spring 62, forcing each irrigation conduit 52 upwardly to the extended position shown partially in FIG. 4. Similarly to the embodiment shown in FIGS. 1 and 2, the water is ultimately emitted at emitters or orifices (not shown) associated with each irrigation conduit 52, to irrigate an area under and adjacent to each extended conduit.

In the form of the invention shown in FIGS. 3 and 4, the rigid housing chamber 42 may be buried to the level shown in the figures or may extend substantially above the surface. Positioning the discharge end 46 of the housing chamber substantially above the soil surface may be desirable to allow the irrigation conduits 52 to clear shrubs and taller landscape plants or features as the conduits are deployed.

Figure 5:
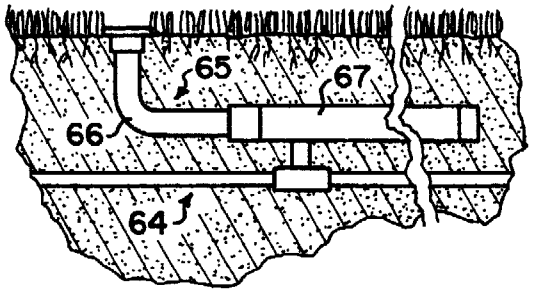
FIG. 5 is a side elevation view showing another alternate form of the invention as installed.

The alternate preferred form of the invention 64 shown in FIG. 5 includes a housing chamber 65 having a flexible top section 66 and a substantially rigid lower section 67. The flexible top section 66 allows the rigid lower section 67 to be positioned conveniently at any desired angle with respect to the soil surface. FIG. 5 shows the flexible top section 66 bent approximately 90° to position the rigid lower section 67 parallel to the surface or generally horizontal. Guide tubes (not shown) similar to the tubes 56 are preferably included in the rigid lower section 67. The flexible top section 66 may include separate flexible guide tubes or preferably includes guide openings integrally formed in the flexible material. However, particular guide tubes may be omitted.

The irrigation conduits (not shown in FIG. 5) in this alternate form of the invention may be positioned within guide tubes similarly to the embodiment shown in FIGS. 3 and 4. However, the guide tubes in the embodiment of FIG. 5 preferably extend only the length of the rigid section 67 and not through the flexible section 66.

Figure 7:
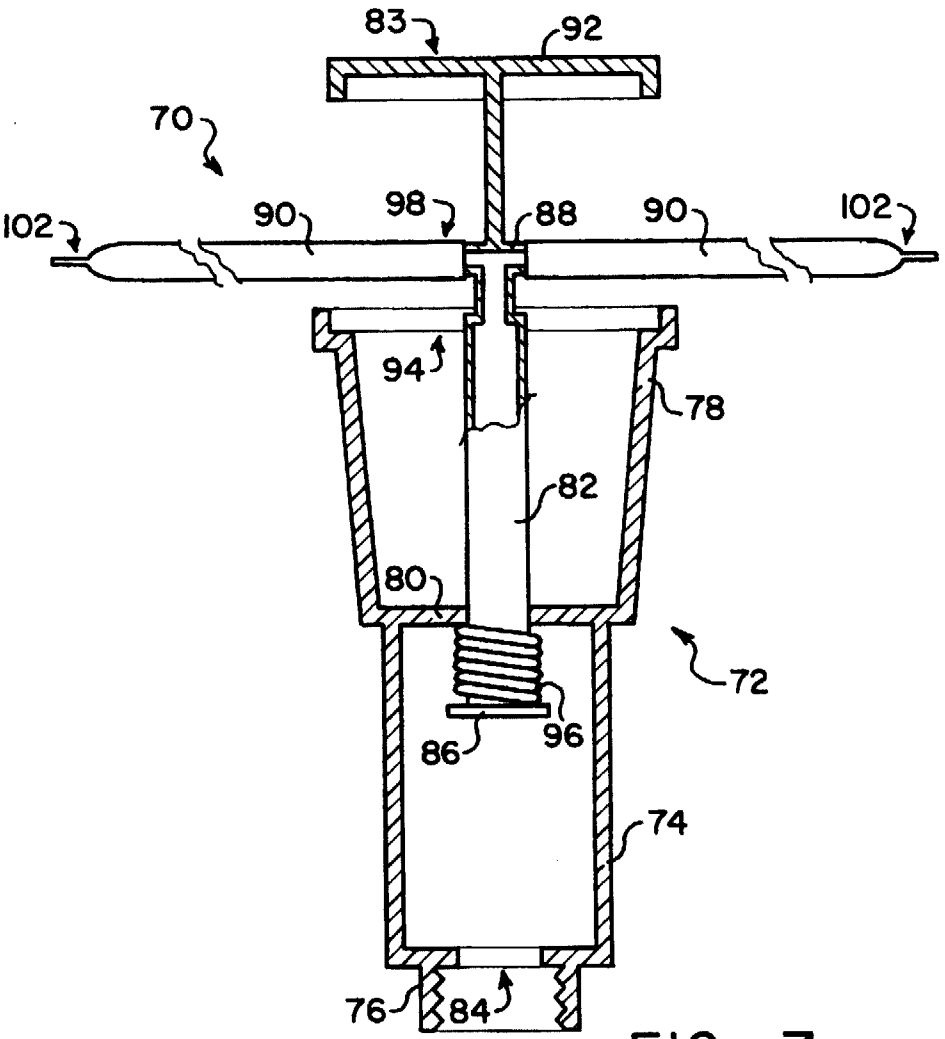
FIG. 7 is a partial longitudinal section view similar to FIG. 6, showing the irrigation conduits in the extended position.
Figure 6:
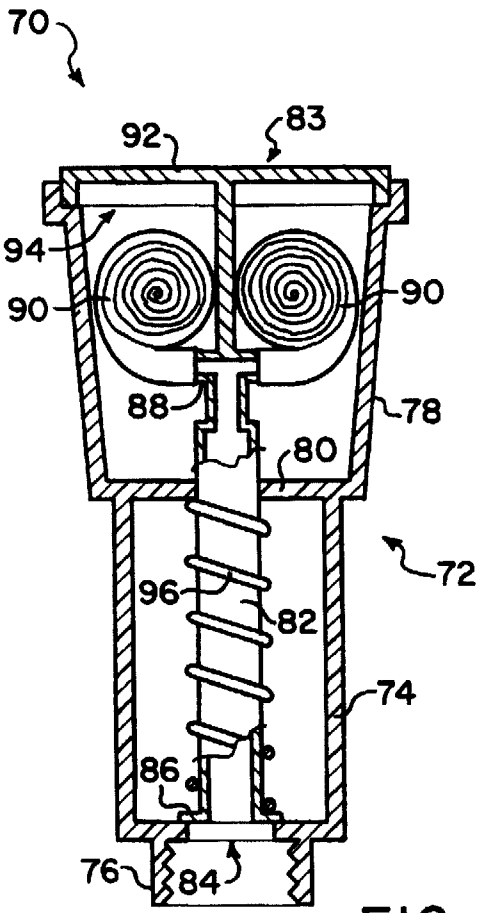
FIG. 6 is a view in longitudinal section of another alternate embodiment of the irrigation apparatus according to the invention, with the irrigation conduits in the retracted position.

The alternate form of the invention shown in FIGS. 6 and 7 shows an irrigation device 70 having a substantially different housing structure and conduit retracting means, still within the scope of the invention. In this form of the invention, the conduit housing includes a housing 72 very similar to conventional spray head devices. The housing 72 includes a lower vessel 74 with an inlet fitting 76 formed therein, an upper enclosure 78, and a vessel wall 80 separating the lower vessel and the upper enclosure.

The apparatus 70 also includes a pop-up stem or conduit 82 slideably received through the vessel wall 80 and having an upper end 83 and a lower end 84. The lower end 84 includes a stop element 86 to limit the upward movement of the pop-up conduit 82. The upper end 83 of the pop-up conduit 82 includes a manifold 88, to which a plurality of irrigation conduits 90 may be connected. Also connected to the pop-up conduit 82 may be a cover 92 that fits over an opening 94 in the top of the upper enclosure. A pop-up conduit retracting spring 96 acts between the stop element 86 of the pop-up conduit 82 and the vessel wall 80 to bias the lower end 84 of the pop-up conduit downwardly toward the inlet fitting 76 in the lower vessel 74.

In the form of the invention shown in FIGS. 6 and 7, the retracting means includes not only the retracting spring 96 and retractable pop-up conduit or stem 82, but also a coiling spring (not shown) or other coiling element associated with each irrigation conduit 90. The coiling element associated with each irrigation conduit 90 biases each conduit to the position shown in FIG. 6, with the distal end of each conduit rolled up or coiled up tightly to the proximal end 98 connected to receive water through the manifold 88. To accommodate this rolling up action the irrigation conduits 90 in this form of the invention comprise tapes that collapse flat when not pressurized with water. In order for the irrigation conduits 90 to roll up properly to the retracted position shown in FIG. 6, the coiling springs associated with each conduit must be allowed to roll the conduit up before the retracting spring 96 pulls the pop-up stem 82 back into the housing 72. This may be accomplished by making the coiling springs relatively stronger than the retracting spring 96 or by dampening the movement of the pop-up stem 82, such as by including a small orifice at the end 84 of the stem 82.

In operation, the apparatus 70 is connected to a water distribution system (not shown), and is buried in a position similar to a conventional spray head, with the inlet fitting 76 connected to a suitable riser (not shown). Water applied to the lower vessel 74 under an operating pressure forces the pop-up conduit or stem 82 upwardly until the manifold 88 and coiled drip irrigation conduits 90 are positioned above the upper enclosure 78. The water pressure applied to the pop-up stem 82 is also applied through the manifold 88 to the proximal end 98 of each rolled up irrigation conduit 90. The operating pressure is sufficient to overcome the coiling force of the coiling element associated with each irrigation conduit 90, unrolling the conduits to an extended position, as shown in FIG. 7. As with the previously described embodiments, each irrigation conduit 90 includes a plurality of emitters or orifices (not shown) for emitting water at a desired rate when water is supplied under the operating pressure.

Removing the water pressure from the lower vessel 74 allows the irrigation conduits 90 to flatten and the coiling elements associated with each irrigation conduit to again coil the respective conduit up to the position shown in FIG. 7. Also, removing the water pressure allows the retracting spring 96 to force the pop-up stem 82 downwardly to the position shown in FIG. 6, with the entire device out of the way and leaving the irrigated area free from obstructions.

Figure 8:
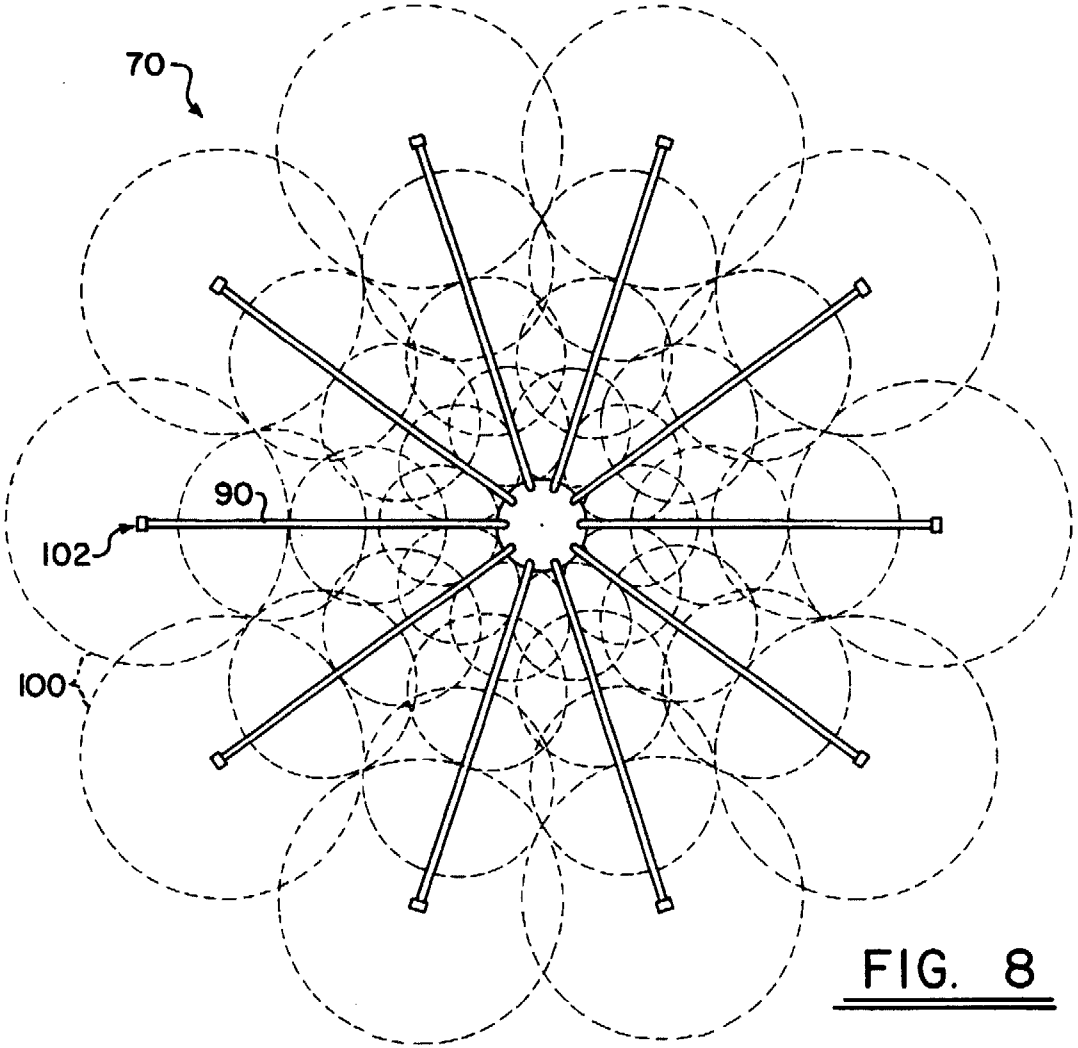
FIG. 8 is a partially schematic top plan view of an irrigation apparatus embodying the principles of the invention, with the irrigation conduits shown in the extended position and showing the wetting patterns associated with each conduit.

FIG. 8 illustrates how the wetting patterns 100 along each irrigation conduit 90 are varied to provide complete coverage of an area to be irrigated surrounding the housing 72. The plurality of emitters or orifices (not shown) spaced apart along the length of each irrigation conduit 90 are varied in spacing and also flow rate, so as to produce an increasingly large wetting area toward the distal end 102 of each conduit. For example, emission flow rate may vary from one gallon per hour near the proximal end of the irrigation conduit to four gallons per hour near the distal end. Also, the wetting depth is decreased in these larger diameter wetting areas produced by higher flow rate. Thus, in the larger irrigated volume towards the distal end, the net depth is equivalent to the lower flow rate emission points closer to the housing. This allows the apparatus 70 to efficiently irrigate not only the relatively close conduit spacings near the housing 72, but also at the relatively wider areas toward the distal ends 102 of the conduits 90.

Those skilled in the art will appreciate that the emission flow rate may be varied along the length of the irrigation conduit in all forms of the invention by varying the size of the emission openings or orifices or by simply including more emission points of the same size. Also, in each form of the invention, the emission openings themselves may be simply openings formed or drilled in some fashion through the conduit material. In the forms of the invention shown in FIGS. 1 through 7, the emission may be through openings or discrete turbulent flow emitters positioned within the conduit.

In all embodiments of the invention the housing chamber, irrigation conduits and guide tubes are all preferably formed from suitable plastic materials. For example, the flexible housing may be low density polyethylene, and the rigid housing and housing shown in FIGS. 6 and 7 may be high density polyethylene. Also, the irrigation conduits could be porous tubes with holes drilled to provide the desired differential water emission along the length.

The above described preferred embodiments are intended to illustrate the principles of the invention, but not to limit the scope of the invention. Various other embodiments and modifications to these preferred embodiments may be made by those skilled in the art without departing from the scope of the following claims.

I claim:

1. An irrigation apparatus comprising:

(a) a plurality of elongated, flexible irrigation conduits having a proximal end and a distal end;

(b) a plurality of drip-type water emitters spaced apart along the length of each irrigation conduit;

(c) a conduit housing for containing the irrigation conduits when the irrigation conduits are in a retracted position, the conduit housing including an elongated housing chamber having a length substantially equal to the length of the irrigation conduits, the chamber having a lower end and a discharge end;

(d) a water supply arrangement associated with the conduit housing and through which water may be supplied to the proximal end of the irrigation conduits;

(e) conduit deployment means for extending the irrigation conduits to an extended position in response to water applied to the water supply arrangement under an operating pressure, the irrigation conduits in the extended position each extending laterally over an area to be irrigated with each emitter positioned at a different lateral distance from the conduit housing;

(f) conduit retracting means associated with the irrigation conduits for retracting the irrigation conduits into the conduit housing in response to the removal of water under the operating pressure from the water supply arrangement;

(g) a separate deployment opening for each conduit in the housing chamber at the discharge end thereof, each irrigation conduit slideably received through one of the deployment openings; and (h) a stop element connected to the proximal end of each irrigation conduit, each stop element cooperating with the respective deployment opening when the respective irrigation conduit is in the extended position to limit the movement of said conduit through the respective deployment opening.

2. The apparatus of claim 1 wherein:

(a) the conduit retracting means is also for retaining the irrigation conduits in the conduit housing in the absence of the water applied to the water supply arrangement under the operating pressure.

3. The apparatus of claim 1 wherein the retracting means includes:

(a) a spring acting on the irrigation conduits to bias said conduits to the retracted position.

4. The apparatus of claim 1 wherein the retracting means includes:

(a) an elastomeric element connected to the conduits, the elastomeric element biasing the conduits to the retracted position.

5. The apparatus of claim 1 wherein the housing chamber is formed from a substantially rigid material.

6. The apparatus of claim 1 wherein the housing chamber is formed from a flexible material.

7. The apparatus of claim 1 wherein the water supply arrangement comprises:

(a) an inlet fitting to the housing chamber through which water may be supplied to the proximal end of the irrigation conduits through the housing chamber.

8. The apparatus of claim 1 wherein:

(a) the irrigation conduits are spaced apart about the housing chamber in the transverse direction thereof and extend through the deployment openings in said housing chamber substantially radially about the conduit housing when the irrigation conduits are in the extended position.

9. The apparatus of claim 8 further comprising:

(a) a guide tube positioned within the chamber for each irrigation conduit, each irrigation conduit residing in one of the guide tubes when in the retracted position; and (b) a plurality of sealing elements, one sealing element connected to the proximal end of each irrigation conduit and providing a sliding seal between said irrigation conduit and the respective guide tube.

10. An irrigation apparatus comprising:

(a) an elongated, flexible irrigation conduit having a proximal end and a distal end;

(b) a plurality of drip-type water emitters spaced apart along the length of the irrigation conduit;

(c) a conduit housing for containing the irrigation conduit when the irrigation conduit is in a retracted position;

(d) a water supply arrangement associated with the conduit housing and through which water may be supplied to the proximal end of the irrigation conduit;

(e) conduit deployment means for extending the irrigation conduit to an extended position in response to water applied to the water supply arrangement under an operating pressure, the irrigation conduit in the extended position extending laterally over an area to be irrigated with each emitter positioned at a different lateral distance from the conduit housing;

(f) conduit retracting means associated with the irrigation conduit for retracting the irrigation conduit into the conduit housing in response to the removal of water under the operating pressure from the water supply arrangement, the retracting means comprising a coiling element associated with the irrigation conduit, the coiling element biasing the irrigation conduit into a coil with the distal end of said conduit coiling toward the proximal end when said conduit is in the retracted position.

11. The apparatus of claim 10 wherein the conduit housing comprises:

(a) a housing body having a lower vessel in which a water inlet is formed, an upper enclosure, and a vessel wall separating the upper enclosure and the lower vessel;

(b) a pop-up conduit slideably received through the vessel wall between the upper enclosure and the lower vessel of the housing body, the pop-up conduit having a closed top end, a bottom opening through which water may be supplied to the pop-up conduit from the lower vessel, and a stop element connected to a bottom part of the pop-up conduit for limiting the travel of the pop-up conduit through the vessel wall; and (c) a manifold connected to a top part of the pop-up conduit, the proximal end of the irrigation conduit being connected to receive, through the manifold, water supplied to the pop-up conduit from the lower vessel.

12. The apparatus of claim 11 further comprising:

(a) pop-up biasing means acting between the housing body and the pop-up conduit to bias the pop-up conduit toward the lower vessel.

13. The apparatus of claim 11 further comprising a plurality of elongated, flexible irrigation conduits and an equal number of coiling elements, each elongated irrigation conduit associated with a different one of the coiling elements and connected at its proximal end to receive water through the manifold.

14. An irrigation method comprising the steps of:

(a) housing an elongated irrigation conduit in a retracted position in a conduit housing;

(b) applying water to a proximal end of the elongated irrigation conduit under an operating pressure;

(c) extending the elongated irrigation conduit through a curved deployment opening to an extended position in response to the water applied to the proximal end of the elongated irrigation conduit under the operating pressure, the elongated irrigation conduit extending over an area to be irrigated when in the extended position and the curved deployment opening bending the irrigation conduit along its length as it slides through the curved deployment opening to direct the conduit to a desired position;

(d) emitting water from a plurality of drip-type emitters spaced apart along the length of the irrigation conduit to the area to be irrigated when the irrigation conduit is in the extended position;

(e) removing the water under the operating pressure from the proximal end of the elongated irrigation conduit; and (f) retracting the elongated irrigation conduit back into the retracted position in the conduit housing in response to the removal of water under the operating pressure.

15. The method of claim 14 wherein the proximal end of the irrigation conduit is fixed to a traveling member slideably received in the housing and the step of applying water to the proximal end of the irrigation conduit includes:

(a) applying water pressure to the traveling member and moving the traveling member to a top of the housing in response to said water pressure.

16. The method of claim 14 wherein the step of retracting the irrigation conduit comprises:

(a) applying a biasing force to the irrigation conduit to bias the proximal end of the irrigation conduit toward a bottom end of the housing.

17. An irrigation method comprising the steps of:

(a) housing an elongated irrigation conduit in a retracted position in a conduit housing;

(b) applying water to a proximal end of the elongated irrigation conduit under an operating pressure;

(c) using the water pressure to overcome a coiling force of a coiling spring member associated with the irrigation conduit, thereby extending the elongated irrigation conduit to an extended position, the elongated irrigation conduit extending over an area to be irrigated when in the extended position;

(d) emitting water from a plurality of drip-type emitters spaced apart along the length of the irrigation conduit to the area to be irrigated when the irrigation conduit is in the extended position;

(e) removing the water under the operating pressure from the proximal end of the elongated irrigation conduit; and (f) retracting the elongated irrigation conduit back into the retracted position in the conduit housing in response to the removal of water under the operating pressure.

18. The method of claim 17 wherein the step of retracting the elongated irrigation conduit to the retracted position comprises:

(a) coiling the irrigation conduit up from the distal end to the proximal end with the coiling element associated with said conduit in response to the removal of the operating pressure from the proximal end of said conduit.

19. The apparatus of claim 1 wherein:

(a) the water emission rates of the drip-type emitters are higher toward the distal end of each conduit and the drip-type emitters are more widely spaced toward the distal end of each conduit.

20. The apparatus of claim 1 wherein the housing chamber includes a flexible section interposed between a top section and a bottom section, the flexible section enabling the top section of the housing chamber to be oriented at an angle to the bottom section of the housing chamber.

* * * * *